US005211550A

United States Patent [19]

Kawabe

[11] Patent Number: 5,211,550

[45] Date of Patent: May 18, 1993

[54] SCROLL TYPE FLUID COMPRESSING APPARATUS WITH A THRUST RING PLATE HAVING FLAT AND PARALLEL CIRCUMFERENTIAL OPPOSITE SURFACES EXTENDING OVER AN OLDHAM RING

[75] Inventor: Isao Kawabe, Shizuoka, Japan

[73] Assignee: Kabushiki Kaisha Toshiba, Kanagawa, Japan

[21] Appl. No.: 823,173

[22] Filed: Jan. 21, 1992

[51] Int. Cl.[5] ..... F04C 18/04

[52] U.S. Cl. ..... 418/55.1; 418/55.3

[58] Field of Search ..... 418/55.1, 55.3, 55.6

[56] References Cited

FOREIGN PATENT DOCUMENTS 58-117380 7/1983 Japan ..... 418/55.6

2-39629 9/1990 Japan .

*Primary Examiner*—John J. Vrablik

*Attorney, Agent, or Firm*—Limbach & Limbach

[57] ABSTRACT

A thrust ring plate of a scroll type compressing apparatus supports the movable scroll member of the apparatus and has flat and parallel circumferential opposite surfaces extending over an Oldham ring in the bearing frame to bear a thrust pressure occurred by the compressing action of the movable scroll member and the stationary scroll member thereby preventing the movable scroll member from the fluctuating movement in a thrust direction perpendicular to the end plate of the movable scroll member and ensuring a smooth orbital movement of the movable scroll member.

4 Claims, 4 Drawing Sheets

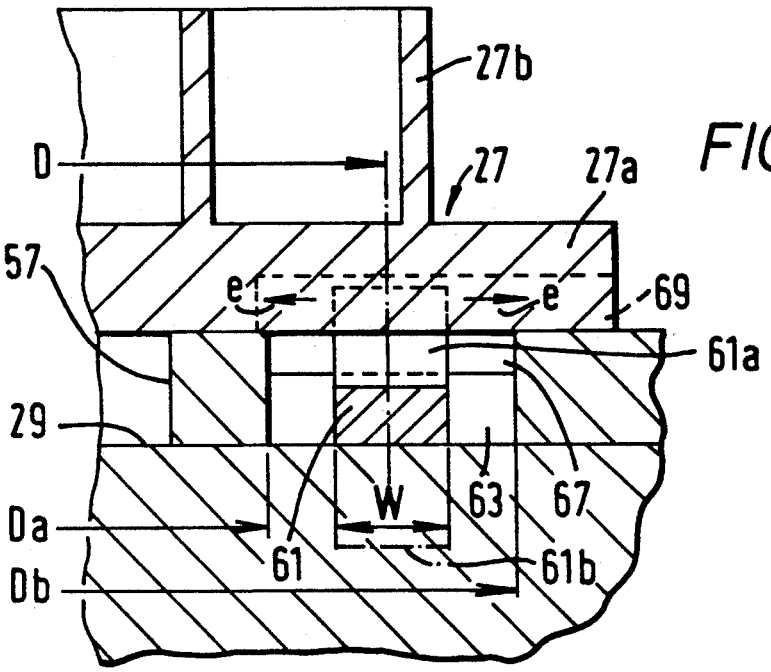
FIG. 5
FIG. 6
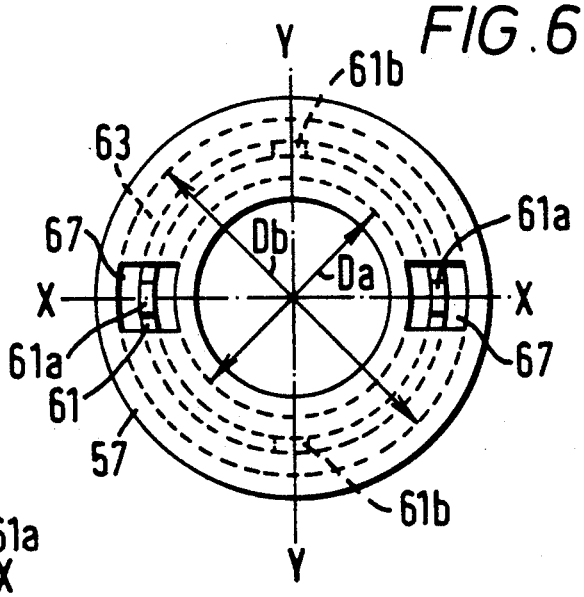
FIG. 7
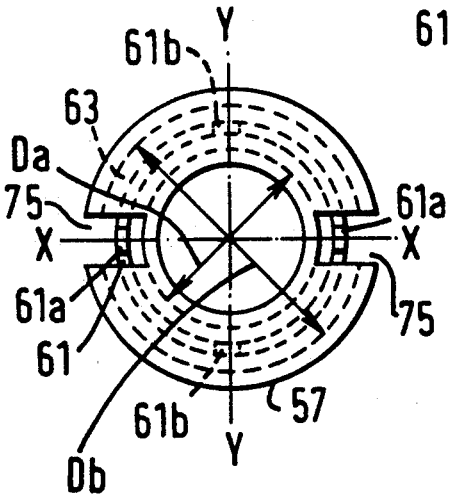
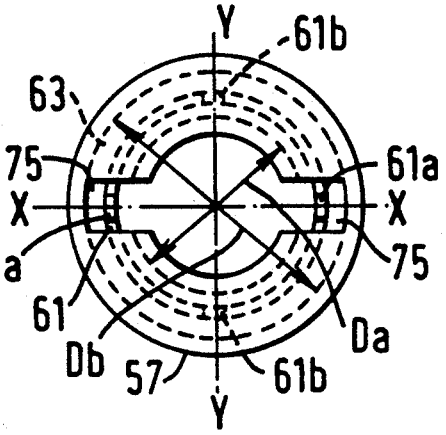
FIG. 8

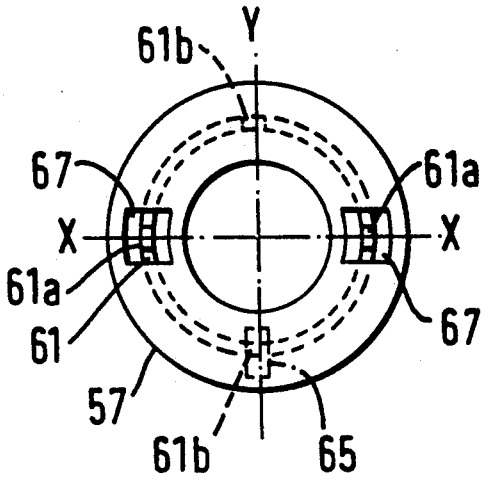
FIG. 9
FIG. 10
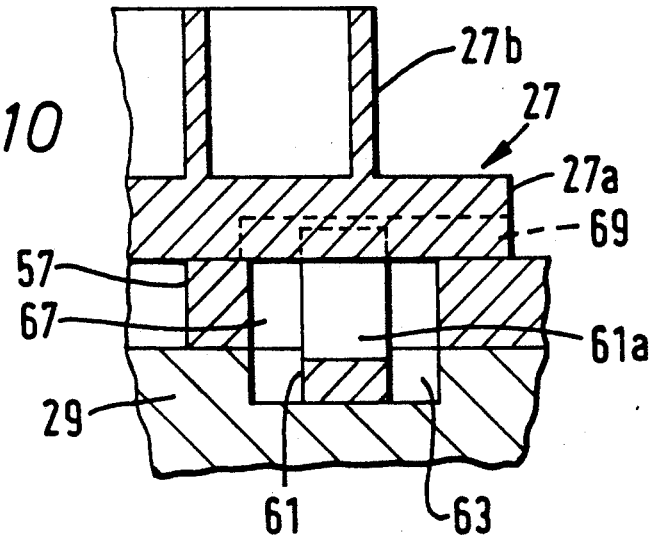
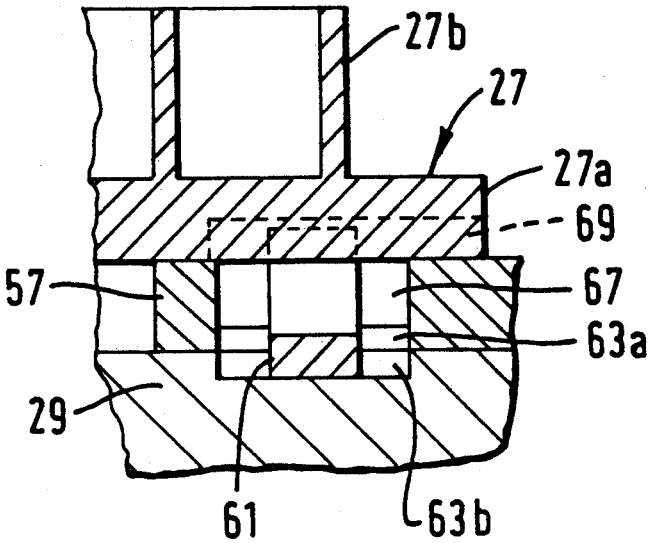
FIG. 11

SCROLL TYPE FLUID COMPRESSING APPARATUS WITH A THRUST RING PLATE HAVING FLAT AND PARALLEL CIRCUMFERENTIAL OPPOSITE SURFACES EXTENDING OVER AN OLDHAM RING

BACKGROUND OF THE INVENTION

1. Field of the Invention

The present invention relates, in general, to fluid compressing apparatus. In particular, the invention relates to a scroll type fluid compressing apparatus, which constitutes an element of the refrigerating circuit of an air conditioning apparatus to compress gaseous refrigerant, for example.

2. Description of the Related Art

As is well known, there are several types of a fluid compressor for compressing gaseous refrigerant flowing through a refrigerating circuit of an air conditioning apparatus. One may be a scroll type fluid compressor. The scroll type fluid compressor carries out a compressing operation without using suction and discharge valves. Thus, the scroll type fluid compressor has a low operational noise and a good compressing ability, as compared with a well known rotary type fluid compressor, for example.

A conventional scroll type fluid compressor typically includes a stationary scroll member and a movable scroll member. Each scroll member has a spiral wrap of involute or the like configuration extending from the surface of the end plate thereof. The stationary scroll member and the movable scroll member are arranged to oppose to one another such that the extended end of each spiral wrap is in contact with the surface of the opposing scroll member. As the movable scroll member moves, the volume of a crescent shaped compressing space defined by the pair of spiral wraps is reduced to carry out the compressing operation for a gaseous fluid, e.g., refrigerant, sealed in the compressing space.

In the above-described scroll type fluid compressor, the movable scroll member is mechanically connected to the eccentric portion of an rotational shaft which is driven by a drive unit, and an eccentric rotational movement of the eccentric portion caused by the rotation of the rotational shaft is transmitted to the movable scroll member. Thus, the movable scroll member is apt to orbitally move with a rotation.

An Oldham coupling is used to ensure the orbital movement of the movable scroll member without the rotation. The Oldham ring is arranged between the movable scroll member and a bearing frame fixed in the casing. The compressing unit including the stationary and movably scroll member and the drive unit including a motor are mounted on the bearing frame, respectively. Thus, the bearing frame rotatably supports the rotational shaft, and fixedly supports the stationary scroll member. The Oldham ring includes a ring-shaped base. A pair of keys is oppositely provided to one of the surfaces of the ring-shaped base in one direction. In addition, a pair of keys is oppositely arranged at the other surface in the direction perpendicular to the one direction. A pair of key seats is provided to a surface of the end plate of the movable scroll member facing to the one of the surfaces of the ring-shaped base, and a pair of key seats is further provided to a surface of the bearing frame facing to the other surface of the ring-shaped base. The Oldham ring is mounted on the bearing frame so that the pair of keys provided on the other surface of the ring-shaped base thereof is located in the pair of key seats of the bearing frame. Furthermore, the movable scroll member is mounted on the Oldham ring so that the pair of keys formed on the one of the surfaces of ring-shaped base is located in the pair of key seats of the movable scroll member. The Oldham coupling is assembled, as described above. Since the bearing frame is fixed in the casing, the rotation of the movable scroll member is avoided.

On the other hand, a thrust pressure is generated when the gaseous fluid is pressurized within the movable and stationary scroll members, and is applied to the movable scroll member. If the movable scroll member is directly supported by the bearing frame, the movable scroll member is pressed to the bearing frame by the thrust pressure, and thus a smooth orbital movement of the movable scroll member is not achieved.

To ensure the smooth orbital movement of the movable scroll member, a ring-shaped thrust plate is interposed between the movable scroll member and the bearing frame to support the movable scroll member therethrough. The ring-shaped thrust plate has a smooth surface and a desirable stiffness, and a frictional coefficient thereof is extremely low. The thrust plate is typically made of a cast iron whose surface is treated with a phosphate.

As described above, the Oldham ring and the thrust plate are interposed between the end plate of the movable scroll member and the upper surface of the bearing frame.

Conventional arrangements of the Oldham ring and the thrust plate are shown in FIGS. 1(*a*) and 1(*b*). In FIG. 1(*a*), the inner diameter of Oldham ring 11*a* is greater than the outer diameter of thrust plate 11*b*, and thus thrust plate 11*b* is located inside the Oldham ring 11*a*. As shown in FIG. 1(*b*), a relationship between diameters of the Oldham ring 13*a* and thrust plate 13*b* is opposite to that shown in FIG. 1(*a*). Thus, Oldham ring 13*a* is located inside thrust plate 13*b*. Two pairs of keys 15*a* and 15*b* are provided on the surface of respective Oldham rings 11*a* and 13*a*, and a plurality of oil paths 17 are formed in respective thrust plates 11*b* and 13*b* in a radial direction.

The above-described arrangements achieve the above described functions of a certain extent. However, in one arrangement shown in FIG. 1(*a*), since thrust plate 11*b* supports the movable scroll member with a small ring-shaped area, an amount of the fluctuating movement of the movable scroll member in a thrust direction is increased and the leakage of the gaseous fluid from the compressing space may occur. In another arrangement shown in FIG. 1(*b*), since the thrust pressure applied to Oldham ring 13*a* through the movable scroll member is relatively large, a smooth orbital movement of the movable scroll member may not be achieved.

Japanese Laid-open patent 2-39629 published Sep. 6, 1990 discloses another arrangement of an Oldham coupling and a thrust plate wherein an overhang is integrally formed at one side of the thrust plate facing to the bearing surface side of the movable scroll member. The overhang of the thrust plate extends along the surface of the movable scroll member in a radius direction and overhangs above the Oldham ring. The bearing surface of the overhang portion of the thrust plate is formed so that it is elastically deformed to enhance a lubricating ability. Wear or damages of the thrust plate is avoided. However, since the overhang portion of the thrust plate is elastically deformed during the operation, it is difficult to avoid the fluctuating movement of the movable scroll member in a thrust direction, and thus the leakage of the gaseous fluid from the compressing space may occur.

SUMMARY OF THE INVENTION

Accordingly, it is an object of the present invention to avoid the fluctuating movement of a movable scroll member of a scroll type fluid compressor in a thrust direction.

It is another object of the invention to ensure a thrust plate a sufficient slidable surface area against a movable scroll member irrespective of the size of an Oldham-ring in a scroll type fluid compressor.

To accomplish the above-described objects, a scroll type fluid compressing apparatus comprising:

a casing;

a bearing frame supported in the casing, the bearing frame having a surface defining a cylindrical recess;

a ring having a pair of first keys each oppositely located and projected from one of the surfaces thereof and a pair of second keys each located at right angles with the first keys pair and projected from the other surface thereof, the ring being located in the cylindrical recess and movable in a reciprocative direction along a line connected between the pair of first keys thereof;

a ring-shaped thrust plate located in the cylindrical recess and having flat and rigid circumferential opposite surfaces extending over the ring in the recess, the thrust plate having a pair of openings through which the pair of second keys respectively project;

a compressing unit supported by the bearing frame for compressing gaseous fluid, the compressing unit having a movable scroll member mounted on the thrust plate, the movable scroll member having a pair of grooves into which the projecting ends of the pair of second keys are respectively inserted; and driving unit, including an eccentric rotational shaft mechanically connected to the movable scroll member, for causing an orbital movement of the movable scroll member by the movement of the ring in the reciprocative direction.

BRIEF DESCRIPTION OF THE DRAWINGS

These and other objects and advantages of this invention will become more readily appreciated from the following detailed description of the presently preferred exemplary embodiments of the invention, taken in conjunction with the accompanying drawings, wherein like reference numerals throughout the various figures denote like structure elements and wherein;

FIG. 1(*b*) is a plan view illustrating another example of the conventional arrangement of the thrust ring plate and Oldham ring;

FIG. 5 is an enlarged sectional view illustrating another mutual relationship of the end plate, the thrust ring plate and Oldham ring shown in FIG. 2;

FIG. 6 is a plan view illustrating the thrust plate with Oldham ring shown in FIGS. 4 and 5;

FIG. 7 is a plan view illustrating a modification of the thrust ring plate with Oldham ring of one embodiment;

FIG. 8 is a plan view illustrating a second modification of the thrust ring plate with Oldham ring of one embodiment;

FIG. 9 is a plan view illustrating a third modification of the thrust ring plate with Oldham ring of one embodiment;

FIG. 10 is an enlarged sectional view illustrating a mutual relationship of the end plate of the movable scroll member, the thrust ring plate, Oldham ring and a bearing frame of the third modification shown in FIG. 9; and FIG. 11 is an enlarged sectional view illustrating a mutual relationship of the end plate of the movable scroll member, the thrust ring plate, Oldham ring, and the bearing frame of a fourth modification of the one embodiment.

DETAILED DESCRIPTION OF THE PREFERRED EMBODIMENT

Figure 1A:
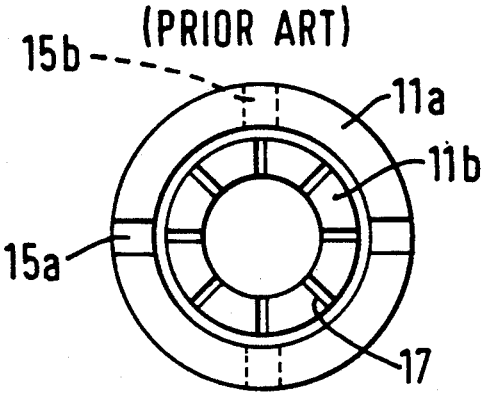
FIG. 1a (PRIOR ART)
FIG. 1(*a*) is a plan view illustrating one example of a conventional arrangement of a thrust ring plate and an Oldham ring.
Figure 1B:
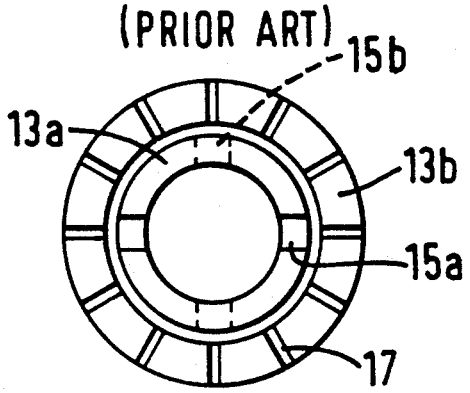
FIG. 1b (PRIOR ART)

A preferred embodiment of the present invention will now be described in more detail with reference to accompanying drawings. However, it is to be noted that similar parts are designated by same reference numerals throughout the accompanying drawings, and therefore the detailed descriptions thereof are not repeated.

Figure 2:
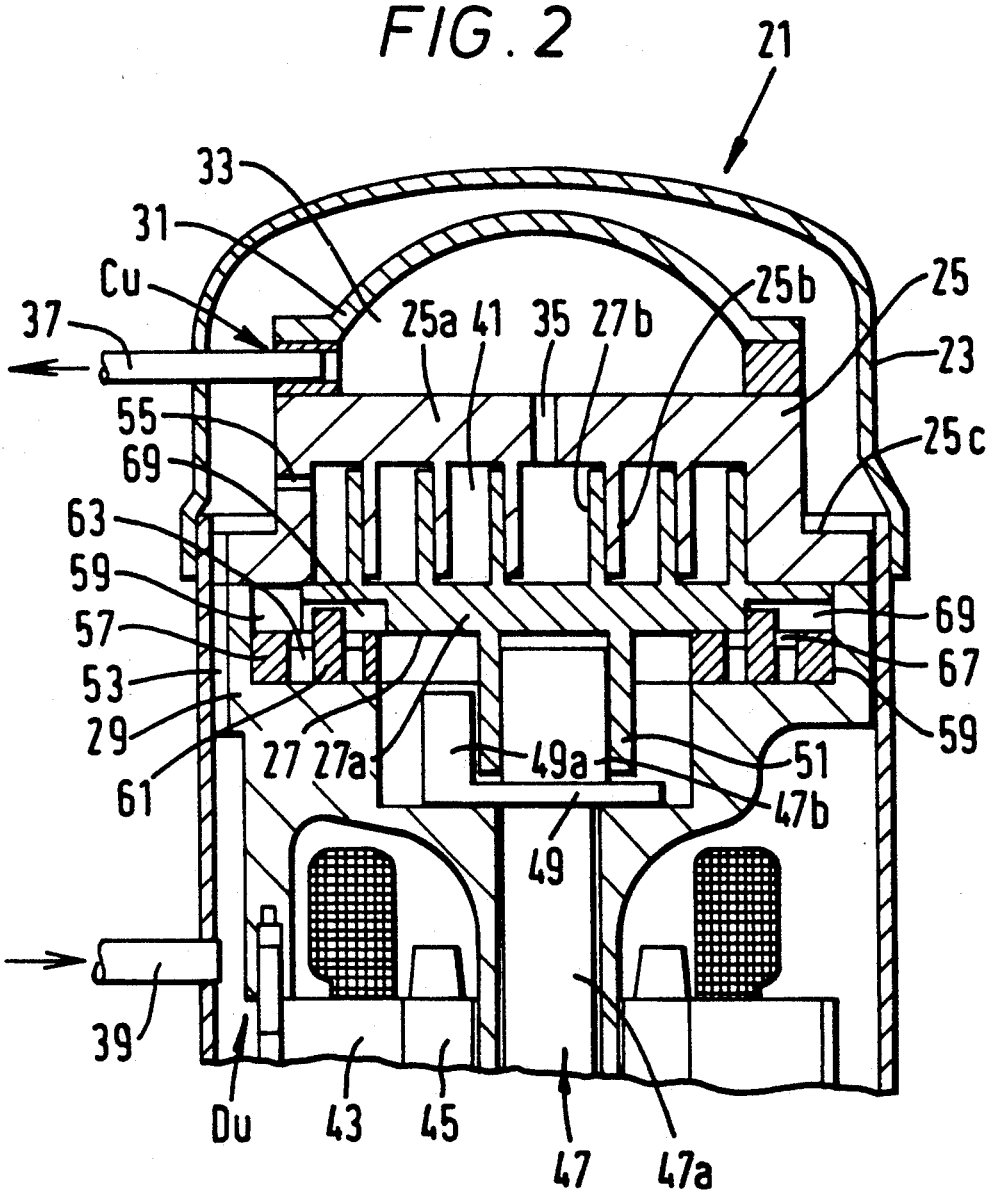
FIG. 2 is a longitudinal sectional view illustrating a part of a scroll type fluid compressing apparatus of one embodiment of the present invention.

As shown in FIG. 2, a scroll type fluid compressor 21 includes a driving unit Du and a compressing unit Cu arranged in a sealed case 23. Compressing unit Cu including a stationary scroll member 25 and a movable scroll member 27 is mounted on one surface of a bearing frame 29, which is firmly supported by an inner wall of case 23. Compressing unit Cu also includes a valve cover 31, which is mounted on the end plate 25*a* of stationary scroll member 25 so that a high pressure discharge chamber 33 is defined between valve cover 31 and end plate 25*a*.

A center portion of stationary scroll member 25 is raised so as to form end plate 25*a*. A stationary spiral wrap 25*b* of involute or the like configuration projects from the inner surface of end plate 25*a* toward movable scroll member 27. A discharge port 35 is formed in the vicinity of the center of stationary spiral wrap 25*b*. Thus, the inside of stationary scroll member 25 and high pressure discharge chamber 33 are mutually communicated with one another through discharge port 35. A discharge pipe 37 penetrates into sealed case 23 and extends to high pressure discharge chamber 33 to communicate with the inside of high pressure discharge chamber 33. Discharge pipe 37 is adapted for the connection with a heat-exchanger when fluid compressor 21 is used in a refrigerating circuit.

An intake pipe 39 is fixed to the side surface of sealed case 23 and communicates with the inside of sealed case 23 wherein driving unit Du is disposed. Intake pipe 39 is also adapted for the connection with a heat-exchanger when fluid compressor 21 is used in a refrigerating circuit.

Movable scroll member 27 includes an end plate 27*a*, outer surface of which is overlapped with the bottom edge, i.e., flange portion 25*c*, of stationary scroll member 25. A compressing compartment 41 is established between end plate 25*a* of stationary scroll member 25 and end plate 27*a* of movable scroll member 27. A movable spiral wrap 27*b* of involute or the like configuration also projects from the inner surface of the end plate 27*a* of movable scroll member 27 toward compressing compartment 41, and slidably contacts with the inner surface of end plate 25*a* of stationary scroll member 25. Similarly, stationary spiral wrap 25*b* is held in contact with the inner surface of end plate 27*a* of movable scroll member 27. As a consequence, the walls of stationary spiral wrap 25*b* and movable spiral wrap 27*b* are held in continuous contact with one another, and thus a plurality of compressing spaces of crescent shape are established by the positional relationship between two spiral wraps 25*b* and 27*b*.

Driving unit Du including a stator 43 and rotor 45 is mounted on the other surface of bearing frame 29. Driving unit Du and movable scroll member 27 of compressing unit Cu are connected through a rotational shaft 47 rotatably supported by bearing frame 29. Rotational shaft 47 includes a main shaft portion 47*a* and an eccentric shaft portion 47*b* integrally formed at the top of main shaft portion 47*a*. The center of eccentric shaft portion 47*b* is offset at a predetermined distance from the center of main shaft portion 47*a*. Main shaft portion 47*a* of rotational shaft 47 extends into rotor 45 and is firmly connected with rotor 45. A balancer 49 is fixed to eccentric shaft portion 47*b* so that a counterpoise 49*a* of balancer 49 is disposed in parallel to eccentric shaft portion 47*b* to be rotated smoothly.

A cylindrical bearing portion 51 is integrally formed on the outer surface of end plate 27*a* of movable scroll member 27 and received eccentric shaft portion 47*b* of rotational shaft 47.

A plurality of intake passages 53 are respectively formed in the outer circumferential surface of bearing frame 29, and therefore a gaseous fluid from intake pipe 39 flows from the driving unit side to the compressing unit side through the plurality of intake passages 53. Furthermore, the gaseous fluid at the compressing unit side is taken into the outer-most compressing compartment 41 through an intake opening 55 formed in the outer wall of stationary scroll member 25.

Figure 4:
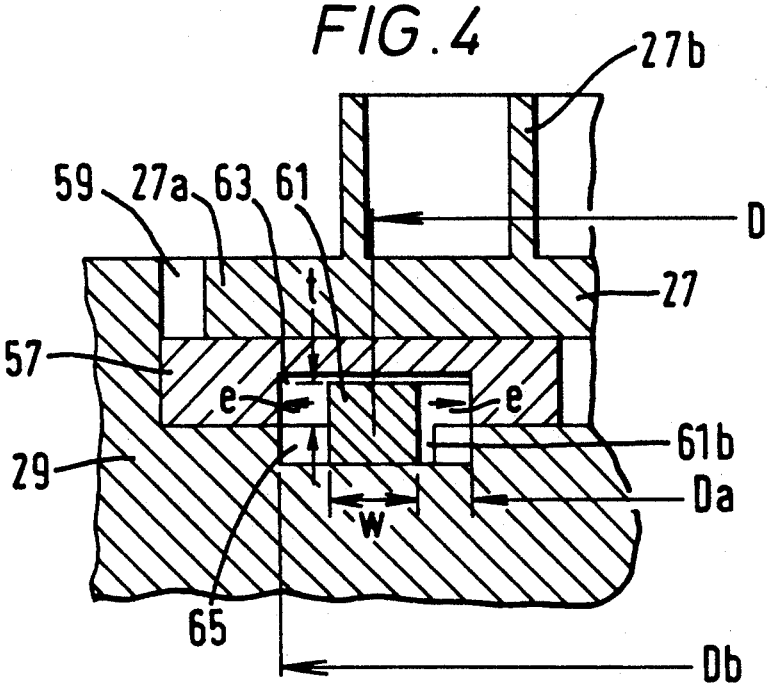
FIG. 4 is an enlarged sectional view illustrating a mutual relationship of an end plate of a movable scroll member, a thrust ring plate and Oldham ring shown in FIG. 2.

A thrust ring plate 57 is fitted in a cylindrical recess 59, formed in the upper surface of bearing frame 29, to bear the thrust load (pressure) of movable scroll member 27. Thrust ring plate 57 is formed in a flat and rigid plate shape. Thus, thrust ring plate 57 has parallel opposite flat surfaces, as shown in FIG. 4.

Flange of stationary scroll member 25 is supported by the circumferential wall of bearing frame 29, which defines cylindrical recess 59.

A center portion of cylindrical recess 59 is further depressed to receive the coupling of eccentric shaft portion 47*b* of rotational shaft 47 and cylindrical bearing portion 51 of movable scroll member 27 and balancer 49.

A ring 61, referred to as an Oldham ring, is also disposed in cylindrical recess 59 to prevent the free rotation of movable scroll member 27 around its own axis (eccentric shaft 47*b*).

Figure 3:
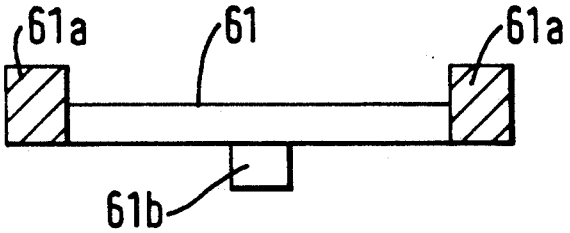
FIG. 3 is a sectional view of one example of Oldham ring used in the scroll type fluid compressing apparatus shown in FIG. 2.

As shown in FIG. 3, a pair of upper side keys 61*a* is oppositely located in a radial direction and projects from the upper surface of ring 61. A pair of lower side keys 61*b* is also located in a radial direction and projects from the lower surface of Oldham ring 61. The pair of upper side keys 61*a* is located at a right angles with the pair of lower side keys 61*b*.

As shown in FIGS. 4 and 5, a circular shaped groove 63 is formed in a circumferential surface of thrust plate 57 contacting the surface of cylindrical recess 59 of bearing frame 29 to receive Oldham ring 61. A pair of depressions 65 is respectively formed in portions of the surface of cylindrical recess 59 corresponding to the pair of lower side keys 61*b*. Thus, the pair of lower side keys 61*b* is received in the pair of guide depressions 65 and is guided in a radial direction to reciprocate along the pair of guide depressions 65 in response to the rotation of eccentric shaft portion 47*b* of rotational shaft 47. A depth of circular shaped groove 63 is greater than the thickness t of Oldham ring 61. An inner diameter Da and an outer diameter Db of circular shaped groove 63 are expressed by the following relationship:

$$Da < D - W/2 - e$$

and $$Db > D + W/2 + e$$

Wherein D is a distance between centers of width of Oldham ring 61 in a radial direction, W is width of Oldham ring 61 and e is an eccentric amount (offset amount) of eccentric shaft portion 47*b*.

As shown in FIGS. 5 and 6, a pair of openings 67 is respectively formed in portions of the bottom surface of circular shaped groove 63 corresponding to the pair of upper side keys 61*a* to project the pair of upper side keys 61*a* therethrough. Projected top portions of the pair of upper side keys 61*a* extend into a pair of grooves 69 formed in the other surface of end plate 27*a* of movable scroll member 27, as shown in FIG. 5. Each groove 69 extends from the circumferential wall of end plate 27*a* toward the center of end plate 27*a* at a prescribed distance. Thus, movable scroll member 27 can move along the pair of upper side keys 61*a* in the direction perpendicular to a virtual line connecting the pair of lower side keys 61*b*.

The compressing operation of the above-described scroll type compressing apparatus will be described. When driving unit Du is activated, compressing unit Cu is driven through rotational shaft 47. A gaseous fluid, e.g., refrigerant, is introduced into sealed case 23 through intake pipe 39. The gaseous fluid further flows to a space in sealed case 23, where compressing unit Cu is disposed, through the plurality of intake passages 53 formed in the outer circumferential surface of bearing frame 29. Thus, the gaseous fluid is gradually filled in sealed case 23.

In response to the rotation of rotational shaft 47, movable scroll member 27 of compressing unit Cu carries out an orbital movement because of an eccentric rotation of eccentric shaft portion 47*b*. The gaseous fluid in sealed case 23 is taken into the inside of compressing unit Cu through intake opening 55 formed in the outer wall of stationary scroll member 25 and is further taken into the outer-most compressing compartment 41 defined by stationary and movable spiral warps 25*b* and 27*b*. The gaseous fluid filled in the outer-most compressing compartment 41 is moved toward the center of compressing unit Cu and is simultaneously pressurized as the orbital movement of movable scroll member 27 is proceeded. When the gaseous fluid is pressurized to a prescribed value and reaches the center of compressing unit Cu, the gaseous fluid is finally discharged to high pressure discharge chamber 33 through discharge port 35. The gaseous fluid in high pressure discharge chamber 33 is further discharged to the outside of sealed case 23 through discharge pipe 37.

Since those processes of compressing gaseous fluid are well known, detailed descriptions thereof are not described.

If the above-described scroll type compressing apparatus 21 is used in a refrigerating circuit of an air conditioning apparatus (not shown), the gaseous fluid discharged from sealed case 23 flows into a heat exchanger. Driving unit Du is controlled with a suitable driving frequency fed from an inverter circuit (not shown) in response to an amount of air conditioning load. Thus, an air conditioning with a suitable condition is achieved.

During the compressing operation of the above-described scroll type compressing apparatus 21, the eccentric rotation of eccentric shaft portion **47*b* is changed to the orbital movement of movable scroll member 27 by the operation of Oldham ring 61. Oldham ring 61 is reciprocated in a Y—Y direction shown in FIG. 6 because of the reciprocating movement of the pair of lower side keys 61*b* of Oldham ring 61. The pair of lower side keys 61*b* moves along the pair of depressions 65 formed in bearing frame 29 in response to the eccentric rotation of eccentric shaft portion 47*b*. On the other hand, movable scroll member 27 can be moved by the guide of the pair of upper side keys 61*a* of Oldham ring 61 in an X—X direction perpendicular to the Y—Y direction shown in FIG. 6. The orbital movement of movable scroll member 27 is achieved without the rotation thereof in response to the eccentric rotation of eccentric shaft portion 47*b* of rotational shaft 47. In particular, the pair of openings 67 is respectively formed in portions of the bottom surface of circular shaped groove 63 of thrust ring plate 57 corresponding to the pair of upper side keys 61*a*. The pair of upper side keys 61*a* project from thrust ring plate 57 through the corresponding openings 67 and is engaged with the corresponding grooves 69 formed in end plate 27*a* of movable scroll member 27 without any difficulty despite Oldham ring 61 is located in circular shaped groove 63 of thrust plate 57. In addition, the inner diameter Da of circular shaped groove 63 is smaller than a value of the expression of $D-W/2-e$ and the outer diameter Db thereof is greater than a value of the expression of $D+W/2+e$. Thus, Oldham ring 61 can be reciprocated in the Y—Y direction in circular shaped groove 63** with a suitable margin.

Also, during the compressing operation of the above-described scroll type compressing apparatus 21, thrust ring plate 57 fitted in cylindrical recess 59 of bearing frame 29 supports end plate **27*a* of movable scroll member 27. Thus, thrust ring plate 57 receives the thrust load (pressure) occurring to movable scroll member 27 as the compressing operation of compressing unit Cu is progressed and ensures a smooth orbital movement of movable scroll member 27. Thrust ring plate 57 has an upper flat surface which supports end plate 27*a* of movable scroll member 27 in a slidable state and a lower flat surface which is supported by the bottom surface of cylindrical recess 59. End plate 27*a* of movable scroll member 27 is firmly supported by the entire flat and wide area of the upper surface of thrust ring plate 57 extending from the inner circumferential side to the outer circumferential side. Thus, the pressure acting on a unit area of the upper surface of thrust ring plate 57 on which end plate 27*a* is moved is reduced, as compared with the conventional scroll type fluid compressor. An elastically deformation and the fluctuating movement of end plate 27*a* of movable scroll member 27 in a thrust direction are avoided, and therefore leakage of the gaseous fluid from the compressing compartment 41** of compressing unit Cu is avoided.

It should be noted that the lubricating ability of the above-described compressing apparatus is not affected by the flat and rigid thrust ring plate, as compared with the conventional scroll type compressor. This is because the thrust pressure acting on the outer surface (circumferential surface) of the thrust ring plate is a relatively small compared with that on the inner surface of the thrust ring plate.

In the above-described embodiment, the pair of openings 67 through which the pair of upper side keys **61*a* of Oldham ring 61 projects is formed through the bottom surface of circular shaped groove 63. However, a pair of cut portions 75 extending from the outer circumferential surface of thrust ring plate 57 to the inner circumferential surface of circular shaped groove 63 may be formed in thrust ring plate 57, instead of the pair of openings 67, as shown in FIG. 7. The pair of cut portions 75 may be formed so that it extends from the inner circumferential surface of thrust ring plate 57 to the outer circumferential surface of circular shaped groove 63, as shown in FIG. 8. In both cases, since an operation of the pair of cut portions 75, shown in FIGS. 7 and 8, are similar to that of the pair of openings 67 in one embodiment, the pair of cut portions 75** is interpreted as a pair of openings.

Circular shaped groove 63 in which Oldham ring 61 is located is formed in thrust ring plate 57. However, circular shaped groove 63 may be formed in the surface of bearing frame 29 on which thrust ring plate 57 is supported, and only the pair of openings 67 may be formed in thrust ring plate 57, as shown in FIGS. 9 and 10. In this modification, circular shaped groove 63 formed in the surface of bearing frame 29 is in communication with the pair of grooves 65, shown in FIG. 9, formed in the surface of bearing frame 29. A detail of the pair of grooves 65 is described in one embodiment. Furthermore, circular shaped groove 63 may be divided into a first circular shaped groove **63*a* and a second circular shaped groove 63*b* and may be formed over the surfaces of thrust ring plate 57 and bearing frame 29 contacting with each other, as shown in FIG. 11. In this case also, first circular shaped groove 63*a* formed in thrust ring plate 57 is in communication with the pair of openings 67 formed in thrust ring plate 57, and second circular shaped groove 63*b* formed in bearing frame 29 is in communication with the pair of grooves 65 formed in bearing frame 29, as similar to the above-described modification. Since a relationship between second circular shaped groove 63*b* formed in bearing frame 29 and the pair of grooves 65 is similar to those in the above-described modification, the relationship may be understood by referring FIG. 9**.

With the present invention, since the thrust ring plate is formed in a flat and rigid plate shape and the pair of openings is formed through the thrust ring plate, the upper side keys of Oldham ring is respectively engaged with the corresponding grooves formed in the movable scroll member through the pair of openings although Oldham ring is located under the thrust ring plate. The thrust ring plate has an extended and rigid circumferential bearing surface and secures a sufficient slid-contact surface area supporting a thrust pressure of the movable scroll member. Thus, the thrust ring plate prevents the end plate of the movable scroll member from fluctuatingly moving in a direction perpendicular to the thrust ring plate during the orbital movement. A leakage of the gaseous fluid from the compressing unit Cu is also avoided. A coefficient of performance (COP) and a reliability of the scroll type fluid compressing apparatus are greatly improved.

The present invention has been described with respect to a specific embodiment. However, other embodiments based on the principles of the present invention should be obvious to those of ordinary skill in the art. Such embodiments are intended to be covered by the claims.

What is claimed is:

1. A scroll type fluid compressor apparatus comprising:

a casing;

a bearing frame supported in the casing, the bearing frame having a surface defining a cylindrical recess;

a ring having a pair of first keys each oppositely located and projected from one of the surfaces thereof and a pair of second keys each located at right angles with the first keys pair and projected from the other surface thereof, the ring being located in the cylindrical recess and movable in a reciprocative direction along a line connected between a pair of first keys thereof, the bearing frame including a pair of guide depressions into which the projecting ends of the pair of first keys are respectively inserted;

a ring shaped thrust plate located in the cylindrical recess and having flat and parallel circumferential opposite surfaces extending over the ring recess, the thrust plate having a pair of openings through which the pair of second keys respectively project;

a compressing unit supported by the bearing frame for compressing a gaseous fluid, the compressing unit having a movable scroll member mounted on the thrust plate, an outer-end portion of the thrust plate being interposed between an end plate of the movable scroll member and the bearing frame providing support for the endplate, the outermost circumferential end of the thrust plate being supported by an upright wall of the bearing frame, the movable scroll member having a pair of grooves into which the projecting ends of the pair of second keys are respectively inserted; and a driving unit, including an eccentric rotational shaft mechanically connected to the movable scroll member, for causing on orbital movement of the movable scroll member by the movement of the ring in the reciprocative direction.

2. An apparatus according to claim 1, wherein the thrust plate includes a circular groove, which is in communication with the pair of openings formed therein, for housing the ring.

3. An apparatus according to claim 1, wherein the bearing frame includes a circular groove, which is in communication with the pair of guide depressions, for housing the ring.

4. An apparatus according to claim 1, wherein the thrust plate includes a first circular groove, and the bearing frame includes a second circular groove facing the first circular groove for housing the ring, the first circular groove being in communication with the pair of openings formed in the thrust plate, the second circular groove being in communication with the pair of guide depressions.

* * * * *